United States Patent [19]

Honegger

[11] Patent Number: 4,688,368

[45] Date of Patent: Aug. 25, 1987

[54] METHOD OF PREPARING A SHIPMENT PACKAGE OF PRINTING PRODUCTS ARRIVING IN AN IMBRICATED FORMATION AND PACKAGE OBTAINED THEREBY

[75] Inventor: Werner Honegger, Tann-Rüti, Switzerland

[73] Assignee: FERAG AG, Hinwil, Switzerland

[21] Appl. No.: 818,356

[22] Filed: Jan. 13, 1986

Related U.S. Application Data

[63] Continuation of Ser. No. 525,679, Aug. 23, 1983, abandoned.

[30] Foreign Application Priority Data

Sep. 2, 1982 [CH] Switzerland ..... 5212/82

[51] Int. Cl.[4] ..... B65B 13/02; B65B 63/04

[52] U.S. Cl. ..... 53/399; 206/390; 206/409; 206/320; 229/175; 242/59; 53/430

[58] Field of Search ..... 53/430, 118, 399; 242/59; 206/390, 409, 820; 229/175

[56] References Cited

U.S. PATENT DOCUMENTS

| | | | |
|---|---|---|---|
| 789,707 | 5/1905 | Bellamy | 242/59 |
| 1,819,122 | 8/1931 | Resnat | 206/390 X |
| 3,263,390 | 8/1966 | Dexter | 53/118 |
| 4,063,693 | 12/1977 | Achelpohl | 53/118 |
| 4,171,047 | 10/1979 | Doyle | 206/409 |
| 4,219,129 | 8/1980 | Sedgwick | 206/409 |

*Primary Examiner*—John Sipos

*Attorney, Agent, or Firm*—Werner W. Kleeman

[57] ABSTRACT

The imbricated product formation is fed to a wind-up location and is wound-up to form a product roll at this location. At the start of the wind-up operation the leading edge of the frontmost printed product is rolled back towards the bottom side or surface of this frontmost product which does not contact any one of the following or trailing printed products in the imbricated product formation. The wind-up of the following printed products in the imbricated product formation is effected in the same product winding direction. At the end of the wind-up operation a cover or strapping band is laid around the completed product roll which then holds the product roll together and also possibly protects the same. The winding direction is selected in accordance with the predetermined structure of the imbricated product formation and results in a roll-shaped wound product package which can be disassembled starting from the center thereof without the cover or strapping band having to be released.

28 Claims, 7 Drawing Figures

METHOD OF PREPARING A SHIPMENT PACKAGE OF PRINTING PRODUCTS ARRIVING IN AN IMBRICATED FORMATION AND PACKAGE OBTAINED THEREBY

CROSS-REFERENCE TO RELATED APPLICATION

This application is a continuation of my commonly assigned U.S. patent application Ser. No. 06/525,679, filed on Aug. 23, 1983, now abandoned and entitled "METHOD OF PREPARING A SHIPMENT PACKAGE OF PRINTED PRODUCTS ARRIVING IN AN IMBRICATED FORMATION AND PACKAGE OBTAINED THEREBY".

BACKGROUND OF THE INVENTION

The present invention relates to a new and improved method of preparing a self-contained ready-for-shipment package of printed products arriving in an imbricated formation. The present invention also relates to a package of printed products produced in accordance with such method.

At times throughout this disclosure reference to such method and package will simply generally be made with reference to printed products. While the description to follow, as a matter of convenience, refers to the processing of printed products, obviously other types of products can be conveniently handled, and therefore, the use of this term is not to be construed in a limiting sense in any way whatsoever, but merely is to be viewed as an exemplary and desirable field of application for the inventive measures.

In a method for forming packages from printed products arriving in an imbricated formation as known, for example, from German Patent Publication No. 2,752,514 and from the corresponding U.S. Pat. No. 4,140,052, the printed products are stacked in a vertical stacking compartment or chute. During formation of the product stack partial stacks or stack sections are placed in a cross-wise configuration upon one another. To obtain a sufficient stability of the stack formed from the superimposed stacked printed products the stack must be compressed during and/or at the end of the stacking operation. Subsequently, there is accomplished an intermediate transport of the stack formed of the printed products which are loosely placed one upon the other to a packing station at which the product package is provided with a protective cover constituted by, for example, a plastic foil by means of a wrapping machine. Then, the thus processed product package is provided with a strapping band. For the strapping operation, which frequently is performed in a cross-wise configuration, there is preferably used a cord or plastic strap or band.

As will be readily recognized from the aforementioned discussion, such a formation of packages ready-for-shipment requires a considerable expenditure with respect to apparatus and time. Additionally, the printed products must be compressed during the stacking operation and also during the strapping operation, as already mentioned. This is undesirable because during such compression there is the danger of smearing the printing ink which has not yet completely dried.

On the side of the receiver of the product package it is necessary to open the product package or package for removal of individual printed products therefrom. This requires releasing of the strapping band and in most cases, also removal of the protective cover. Apart from the work connected therewith the opening of the product package is associated with the disadvantage that the printed products are no longer held together in the product package which thus tends to fall apart. Furthermore, transporting of the opened printed product package to a different location may be quite troublesome or cumbersome unless the product package is restrapped prior thereto.

Other patents of interest are:

German Patent No. 2,207,556, published Aug. 30, 1983;

British Patent No. 1,594,558, published July 30, 1981;

British Patent No. 2,102,771, published Feb. 9, 1983;

British Patent No. 2,121,772, published Jan. 4, 1984;

British Patent No. 2,121,389, published Dec. 21, 1983; and

British Patent No. 2,117,359, published Oct. 12, 1983.

SUMMARY OF THE INVENTION

Therefore, with the foregoing in mind it is a primary object of the present invention to provide a new and improved method of preparing a shipment package of printed products arriving in an imbricated formation in a manner which is not afflicted with the aforementioned drawbacks and limitations heretofore discussed and to product packages produced by means of such method.

Another important object of the present invention is directed to the provision of a new and improved method of preparing a shipment package of printed products arriving in an imbricated formation which permits the packages to be formed in a simple and protective manner.

Still a further significant object of the present invention is directed to a new and improved method of preparing shipment packages of printed products arriving in an imbricated formation, which product package can be conveniently handled and from which individual printed products can be removed without difficulty and with very little effort.

Now in order to implement these and still further objects of the invention, which will become more readily apparent as the description proceeds, the method of the present development is manifested by the features that, the imbricated product formation is wound-up from one end thereof to form a product roll or roll, the wind-up operation being started by rolling-in the exposed or free edge of the printed product at one end of the imbricated product formation in a direction towards that side of the aforementioned printed product which is not covered by the following printed product in the imbricated product formation, and the wind-up or winding operation is then continued in the same direction.

Contrary to the initially described prior art method in which the arriving imbricated product formation or imbricated formation first had to be destroyed in order to form a stack, the imbricated formation can be preserved during the wind-up operation. Consequently, the printed products do not have to be released or removed from the imbricated formation prior to the package formation. The package formation thus can be effected in a more simple and in a more product-protective manner as compared to the heretofore known conventional methods.

It is advantageous to place a cover or strapping band element around the product roll formed from the printed products in order to hold the same together. Advantageously, this is effected in such a way that the cover or strapping band element is assembled with the imbricated formation, so as to protrude over an end section thereof and is wound-up conjointly therewith. Preferably, the end section or region of the cover or strapping band element which protrudes past the end section or portion of the imbricated formation when the cover or strapping band element is completely wound-up, is connected with another section of the cover or strapping band element, preferably with the other end section thereof. Thus, the covering or strapping of the roll-shaped product package can be effected during the course of the wind-up operation of the printed products. A separate wrapping or strapping operation thus is not required. The cover can be designed such as to additionally serve for the protection of the printed products in addition to holding the product roll together.

As alluded to above, the invention is not only concerned with the aforementioned method aspects, but also relates to a novel structure of the product package obtained by such method. Generally speaking, the inventive product package comprises printed products and is obtained by winding-up an imbricated formation of products.

To achieve the aforementioned measures and objects of the invention the inventive package of printed products, in its more specific aspects, comprises printed products wound-up to form a product roll; and the printed products are individually removable from the product roll at the center thereof.

The product package obtained in this way by winding-up the imbricated formation is easily handled. Due to the particular manner of wind-up or winding of the imbricated formation, the product package can be disassembled without any great effort from the inside of the product roll without the wound product package having to be opened. The printed products are thus not damaged and no other printed products can be withdrawn conjointly therewith from the product roll. Since the cover or strapping band element is preserved up to the last specimen or copy of the printed product, the printed products are also still held together after removal of some of the printed products from the product package.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
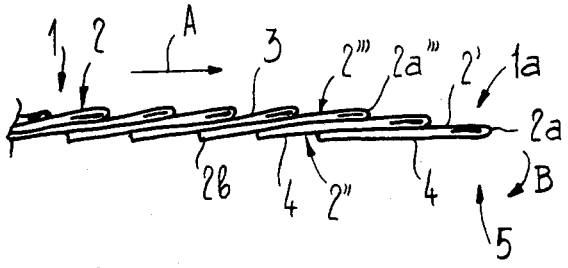
FIGS. 1 to 4 illustrate in a schematic side view the different timewise consecutive phases of the method according to the invention by which an imbricated product formation is wound-up to form a product roll.

Turning attention now specifically to FIGS. 1 to 4 of the drawings, there will be explained in conjunction therewith the formation of a ready-for-shipment package of printed products 2 arriving in an imbricated product formation 1 during different phases of the product package forming process.

The depicted imbricated product formation 1 may constitute part of a longer or more extensive imbricated formation as, for example, outputted by a rotary printing press. This imbricated product formation or imbricated formation 1 is appropriately moved in the direction of the arrow A in a manner not here shown in any particular detail, for example, by means of any suitable band conveyor or the like. Within the imbricated formation 1 the printed products 2 are superimposed in the manner of tiles on a roof, each printed product 2 resting with its bottom side or surface 4 upon a top side or surface 3 of the immediately preceding or leading printed product 2. Thus, a leading edge 2*a*, which in the present case is the folding edge or fold of the printed products 2, is exposed or free while a trailing edge 2*b* of the printed products 2 is covered by the next following or trailing printed product 2.

Figure 2:
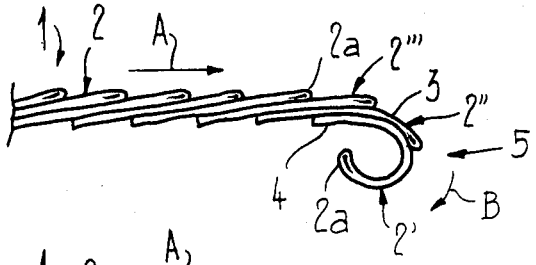
Figure 3:
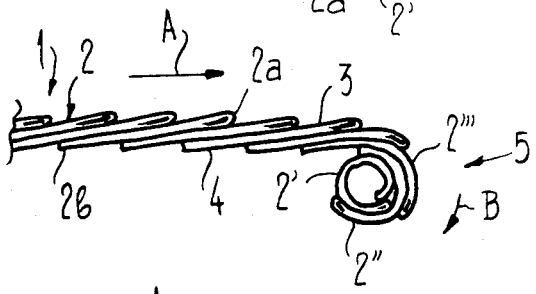

The imbricated formation 1 is conveyed in the direction of the arrow A towards a wind-up location, generally indicated by reference character 5. At the wind-up location 5 the imbricated formation 1 is wound-up starting with a leading end 1*a* thereof, in order to form a product roll. As shown in FIGS. 1 and 2, the winding operation is started in such a way that the leading and exposed or free edge 2*a* of a foremost or forewardmost printed product 2' is rolled-up in the direction towards the bottom side or surface 4 of this first and forwardmost located printed product 2'. As will be evident from FIG. 3, the further winding operation is effected in the same direction or sense. This winding direction is indicated in FIGS. 1 to 4 by the arrow B. Thus, the imbricated formation 1 is wound-up in such a manner that the leading edge 2*a* of each printed product 2 is rolled-back towards the bottom side or surface 4 thereof, and thus, away from the trailing printed products 2. Thus in FIG. 3 the printed product 2' is rolled-back towards the bottom side 4 and away from the subsequent printed products 2'' and 2'''.

As will still be explained in greater detail hereinafter, the winding-up of the imbricated formation 1 in the direction B, as explained heretofore, is a precondition that the printed products 2 can be readily removed from a completed product package or product roll 7.

Towards the end of the wind-up or winding operation a band-shaped cover or strapping band element 6 is applied to a trailing end section 1*b* of the imbricated formation 1. This cover or strapping band element 6 is advantageously formed of a suitable material like, for example, kraft paper or plastic. The width of the cover or strapping band element 6 approximately corresponds to the width of the printed products 2; however, the width thereof may also be smaller than the width of the printed products 2. The cover or strapping band element 6 has a length which is greater by a certain amount than the circumferential length or circumference of the completed product roll 7 of printed products 2.

Figure 4:
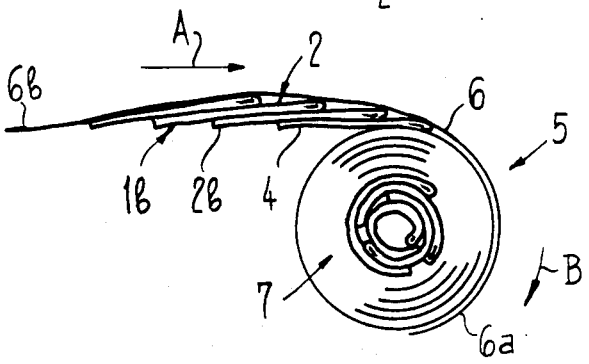
Figure 5:
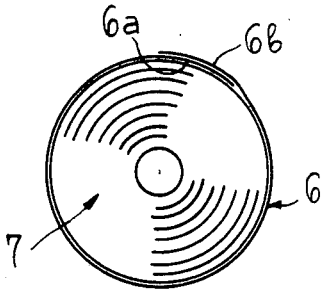
FIGS. 5 and 6 are respective schematic end views, shown in different scales, of a shipment package of printed products produced according to the invention.

As will be evident from FIG. 4, the cover or strapping band element 6 is applied to the trailing end section 1*b* of the imbricated formation 1 in such a way that an end or end section 6*b* of the cover or strapping band element 6 protrudes to the rear beyond the trailing end section 1*b* of the imbricated formation 1. The cover or strapping band element 6 is wound-up conjointly with the trailing end section 1*b* of the imbricated formation 1, and during this operation the cover or strapping band element 6 comes to rest on the outer side or surface of the product roll 7. As shown in FIG. 5 the trailing end 6*b* of the completely wound-up cover or strapping band element 6 overlaps a front end 6*a* of such cover or strapping band element 6. The two overlapping ends or end sections 6*a* and 6*b* are then interconnected in any suitable manner. For example, when one or both of the ends or end sections 6*a*, 6*b* are provided with a suitable self-adhesive prior to applying the cover or strapping band element 6 to the imbricated formation 1, the two ends or end sections 6*a* and 6*b* can be interconnected during the course of the wind-up operation without requiring any significant additional expense. It will be self-evident that the connection between the two ends or end sections 6*a* and 6*b* of the cover or strapping band element 6 can also be effected in a different manner as, for example, by welding or heat sealing in case that a plastic foil is used.

Figure 6:
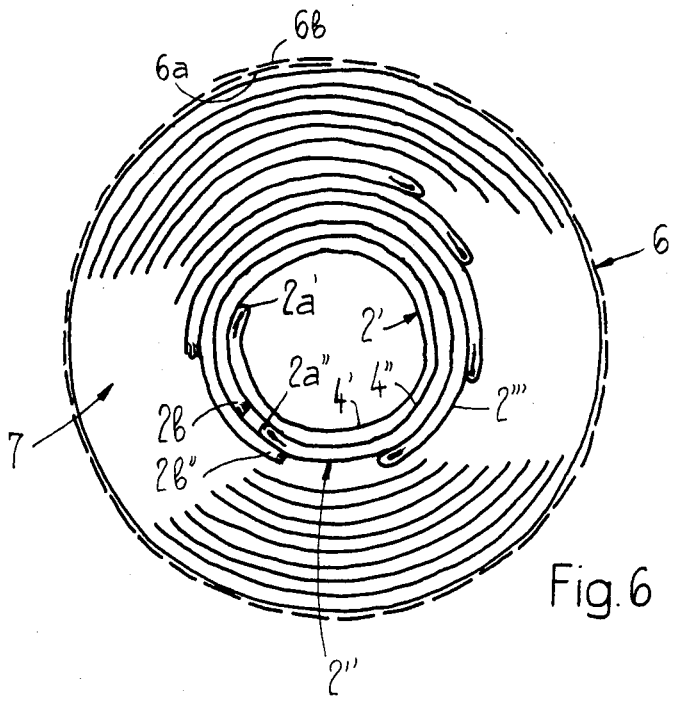

The cover or strapping band element 6 also can be designed to have such a length and also can be applied to the trailing end section 1*b* of the imbricated formation 1 in such a manner that the cover or strapping band element 6 is wound-up with its front end 6*a* between the last individual wound layers or plies of the wound-up printed products 2. FIGS. 5 and 6 show, in different scales, the roll-shaped product package or product roll 7 which is ready for shipment. As will be evident therefrom, the cover or strapping band element 6 encircling the product roll 7 of printed products 2 not only serve to hold the product roll 7 together, but also to protect the wound-up printed products 2. However, the cover or strapping band element 6 may also be designed such as to perform only a protective function, an additional strapping banding element or ligature, for example, a plastic band or a cord being used to hold the product roll 7 together. In case that no protection is required for the printed products 2, it will be sufficient to apply a strapping band or the like to the product roll 7 to form a completed product package.

Figure 7:
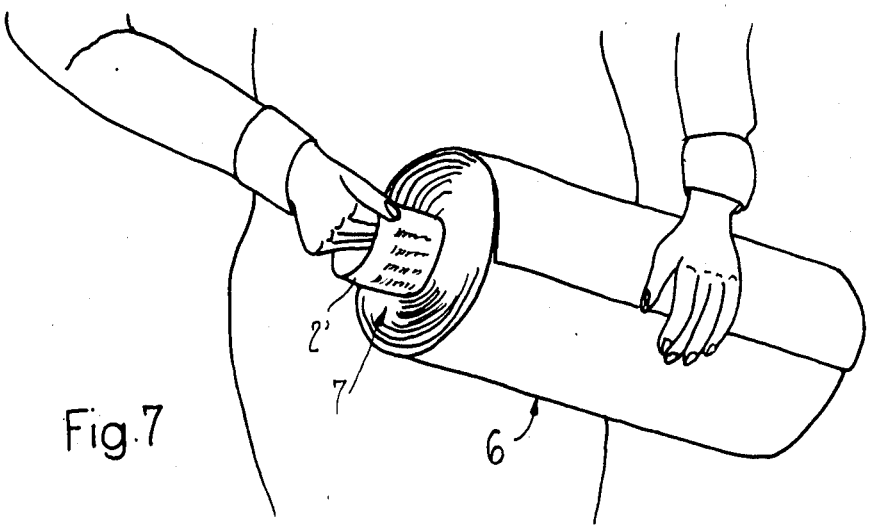
FIG. 7 is a perspective view illustrating the removal of an individual printed product from the roll-shaped product package shown in FIGS. 5 and 6.

In FIG. 6 the structure of the finished roll-like product package 7 will be recognized in greater detail and which finished product package is devoid of any core. Due to the selected winding direction B, as explained with reference to FIGS. 1 to 4, the side or surface 4' of the innermost printed product 2' facing the center of the product roll 7 does not contact any one of the following printed products 2'' or 2'''. The second printed product 2'' only engages the innermost printed product 2' at its inner side or surface 4'' facing the center of the product roll 7. This is similarly the case for the remaining printed products as illustrated by the printed product designated by the reference numeral 2'''. Such arrangement of the printed products 2 within the product roll 7 now permits the roll-shaped package to be disassembled from the interior thereof. This means that the innermost printed product 2 may be withdrawn from the product roll 7 without entraining any further printed products 2 as will be evident from FIG. 7. It will be readily recognized from FIG. 6 that after removal of the innermost printed product 2' the next printed product 2'' in the series no longer contacts any other printed product with its inner side or surface 4'' facing the center of the package roll 7. Consequently, also the second printed product 2'' can be withdrawn without any great effort from the product roll 7 without entraining a further printed product. This is also true throughout for the remaining printed products.

Such a disassembly or build-off of the product package 7 from the interior thereof which, as explained, is effected without any great effort and without damage to individual printed products 2, renders superfluous the opening of the product package 7. This means that the cover or strapping band element 6 may remain present until the end of the disassembling operation. The printed products 2 are thus still held together in their rolled-up shape even when individual specimens or copies have already been removed from the product package 7.

It is also possible that the printed products 2 assume a mutual position within the imbricated product formation or imbricated formation 1 which is different from the one shown in FIGS. 1 to 4. By suitably selecting the wind-up direction, however, it is also possible in such case to obtain a roll-shaped product package 7 which corresponds in structure to the product package 7 shown in FIG. 6. In case that in the arriving imbricated formation 1 each printed product 2 rests with its bottom side or surface 4 on the top side or surface 3 of the following printed product 2, then the imbricated formation 1 would have to be wound-up in a direction which is opposite to the winding direction B as shown in FIGS. 1 to 4. Consequently, the leading edge 2*a* of the first printed product 2' would have to be rolled back upwardly towards the exposed top side or surface 3 of this first printed product 2'.

While there are shown and described present preferred embodiments of the invention, it is to be distinctly understood that the invention is not limited thereto, but may be otherwise variously embodied and practiced within the scope of the following claims.

What I claim is:

1. A method of making and using a self-contained ready-for-shipment package of printed products arriving in an imbricated product formation, comprising the steps of:

winding-up said imbricated product formation from one end thereof to form a product roll wherein successive innermost products are consecutively removable from the center of said product roll;

said winding-up operation being started by rolling-up an exposed edge of the printed product located at said one end of said imbricated product formation in the direction towards that side of said printed product which is not covered by the printed product following said first mentioned printed product in said imbricated product formation;

continuing said winding-up operation in the same direction and thereby forming said product roll of printed products by winding-up said imbricated product formation; and wrapping a cover element at least one complete revolution around said product roll to hold the same together; and consecutively removing said successive innermost printed products from the center of said product roll.

2. A method of preparing a coreless self-contained ready-for-shipment package of printed products arriving in an imbricated product formation, comprising the steps of:

corelessly winding-up said imbricated product formation from one end thereof to form a coreless product roll wherein successive innermost printed products are consecutively removable from the center of said product roll;

said winding-up operation being started by rolling-up an exposed edge of the printed product located at said one end of said imbricated product formation in the direction towards that side of said printed product which is not covered by the printed product following said first mentioned printed product in said imbricated product formation;

continuing said winding-up operation in the same direction and thereby forming said coreless product roll of printed products by winding-up said imbricated product formation; and wrapping a cover element at least one complete revolution around said product roll to hold the same together, thereby enabling the dispensing of said product from the center of said coreless product roll.

3. The method as defined in claim 2, further including the steps of:

conveying said imbricated product formation in a predetermined direction of movement so as to define a leading end thereof; and starting said winding-up operation at said leading end which defines said one end.

4. The method as defined in claim 2, further including the steps of:

conveying said imbricated product formation in a predetermined direction of movement so as to define a trailing end section thereof;

assembling said cover element with said imbricated product formation so as to protrude past said trailing end section of said imbricated product formation; and winding-up said cover element conjointly with said imbricated product formation.

5. The method as defined in claim 4, further including the steps of:

connecting an end section of said cover element which protrudes past said trailing end section of said imbricated product formation with another section of said cover element.

6. The method as defined in claim 4, further including the steps of:

connecting a second end section of said cover element which protrudes past said trailing end section of said imbricated product formation with a first end section of said cover element.

7. The method as defined in claim 2, further including the steps of:

selecting a length of said cover element so as to be greater than the circumferential length of said product roll of printed products when completely wound-up; and interconnecting overlapping sections of said cover element.

8. The package produced according to the method as defined in claim 2.

9. The package as defined in claim 8, wherein:

said printed products are individually removable from the center of said package.

10. The package as defined in claim 9, further including:

an innermost printed product defined by said package;

said innermost printed product having an interior side facing said center of said package; and said interior side being out of contact with any other printed product.

11. The package as defined in claim 9, further including:

an innermost printed product defined by said package;

said innermost printed product having an interior side facing said center of said package; and said interior side being arranged such that no other printed product faces the interior side.

12. The package as defined in claim 8, wherein:

said package, when in a completely wound-up state, possesses a predetermined circumferential length;

said cover element having a length exceeding said circumferential length of said package; and said cover element comprising two interconnected overlapping sections.

13. A method of preparing a coreless self-contained ready-for-shipment package of printed products arriving in an imbricated product formation, comprising the steps of:

directly and corelessly winding-up said imbricated product formation from one end thereof to form a coreless product roll wherein successive innermost products are consecutively removable from the center of said product roll;

said winding-up operation being started by rolling-up an exposed edge of the printed product located at said one end of said imbricated product formation in the direction towards that side of said printed product which is not covered by the printed product following said first mentioned printed product in said imbricated product formation;

continuing said winding-up operation in the same direction and thereby forming said coreless product roll of printed products; and wrapping a strapping band at least one complete revolution around said product roll to hold the same together, thereby enabling the dispensing of said product from the center of said coreless product roll.

14. The method as defined in claim 13, further including the steps of:

conveying said imbricated product formation in a predetermined direction of movement so as to define a leading end thereof; and starting said wind-up operation at said leading end which defines said one end.

15. The method as defined in claim 13, further including the steps of:

conveying said imbricated product formation in a predetermined direction of movement so as to define a trailing end section thereof;

assembling said strapping band with said imbricated product formation so as to protrude past said trailing end section; and winding-up said strapping band conjointly with said trailing end section of said imbricated product formation.

16. The method as defined in claim 15, further including the step of:

connecting an end section of said strapping band which protrudes past said trailing end section of said imbricated product formation with another section of said strapping band.

17. The method as defined in claim 15, further including the step of:

connecting a second end section of said strapping band which protrudes past said trailing end section of said imbricated product formation with a first end section of said strapping band.

18. The method as defined in claim 13, further including the step of:

selecting a length of the strapping band so as to be greater than the circumferential length of said product roll of printed products when completely wound-up; and interconnecting overlapping sections of said strapping band.

19. The package produced according to the method as defined in claim 13.

20. The package as defined in claim 19, wherein:

said printed products are individually removable from said center of said package.

21. The package as defined in claim 19, wherein:

said package, when in a completely wound-up state, possesses a predetermined circumferential length;

said strapping band having a length exceeding said circumferential length of said package; and said strapping band comprising two interconnected overlapping sections.

22. A method of preparing a coreless self-contained ready-for-shipment package of printed products arriving in an imbricated product formation, comprising the steps of:

corelessly winding-up said imbricated formation from one end thereof to form a coreless product roll;

said winding-up operation being started by rolling-up an exposed edge of the printed product located at said one end of said imbricated product formation in the direction towards that side of said printed product which is not covered by the printed product following said first mentioned printed product in said imbricated product formation;

continuing said winding-up operation in the same direction and thereby forming said coreless product roll of printed products by winding-up said imbricated product formation such that successive innermost printed products are consecutively removable; and wrapping a cover element at least one complete revolution around said product roll to hold the same together, thereby enabling the dispensing of said product from the center of said coreless product roll.

23. The package made in accordance with claim 22, wherein:

the package comprises said product roll.

24. A package of printed products formed by corelessly winding-up an imbricated product formation of printed products, said package comprising:

a product roll defining a coreless center and wound-up from said printed products; and an innermost printed product defined by said wound-up product package roll;

said innermost printed product having an interior side facing said center of said product package roll; and said interior side being out of contact with any other printed product;

a cover element extending around said product roll and holding the same together;

thereby enabling the dispensing of successive innermost printed products individually and consecutively from said center of said coreless product roll.

25. The package as defined in claim 24, further including:

an innermost printed product defined by said wound-up roll;

said innermost printed product having an interior side facing said center of said product roll; and said interior side being arranged such that no other printed product faces the same.

26. The package as defined in claim 24, wherein:

said product roll, when in a completely wound-up state, possesses a predetermined circumferential length;

said cover element having a length exceeding said circumferential length of said product roll; and said cover element comprising two interconnected overlapping sections.

27. The package as defined in claim 24, further including:

a strapping band extending around said product roll and holding the same together.

28. The package as defined in claim 27, wherein:

said product roll, when in a completely wound-up state, possesses a predetermined circumferential length;

said strapping band having a length exceeding said circumferential length of said product roll; and said strapping band comprising two interconnected overlapping sections.

* * * * *

UNITED STATES PATENT AND TRADEMARK OFFICE

CERTIFICATE OF CORRECTION

PATENT NO. : 4,688,368

DATED : August 25, 1987

INVENTOR(S) : WERNER HONEGGER

It is certified that error appears in the above-identified patent and that said Letters Patent is hereby corrected as shown below:

Column 10, line 8, after "products;" please delete "and"

Column 10, line 12, after "roll;" please delete "and"

Column 10, line 16, after "together;" please insert --and--

Signed and Sealed this

Twenty-second Day of March, 1988

*Attest:*

*Attesting Officer*

DONALD J. QUIGG

*Commissioner of Patents and Trademarks*